United States Patent [19]

Kankaanpää

[11] 4,113,557

[45] Sep. 12, 1978

[54] PAPER MANUFACTURING STRUCTURE PARTICULARLY FOR DETACHING A WEB FROM A WIRE

[75] Inventor: Matti Kankaanpää, Espoo, Finland

[73] Assignee: Valmet Oy, Finland

[21] Appl. No.: 787,334

[22] Filed: Apr. 14, 1977

[30] Foreign Application Priority Data

Apr. 14, 1976 [FI] Finland ..... 761031

[51] Int. Cl.[2] ..... D21F 1/52

[52] U.S. Cl. ..... 162/301; 162/305; 162/306; 162/307; 162/360 R; 162/364; 162/374

[58] Field of Search ..... 162/205, 203, 301, 305, 162/306, 307, 360 R, 363, 364, 374

[56] References Cited

U.S. PATENT DOCUMENTS

| | | | |
|---|---|---|---|
| 1,701,226 | 2/1929 | Collins | 162/306 X |
| 3,309,263 | 3/1967 | Grobe | 162/306 |
| 3,515,637 | 6/1970 | Reynolds et al. | 162/306 X |
| 3,836,428 | 9/1974 | McConaughy | 162/374 X |
| 3,839,143 | 10/1974 | Suckow | 162/301 X |
| 3,861,996 | 1/1975 | Dorfel | 162/306 X |
| 3,992,253 | 11/1976 | Schiel | 162/306 X |

FOREIGN PATENT DOCUMENTS

| | | | |
|---|---|---|---|
| 7,205,443 | 9/1968 | Japan | 162/306 |

*Primary Examiner*—Richard V. Fisher
*Attorney, Agent, or Firm*—Steinberg & Blake

[57] ABSTRACT

A paper machine has a wire which transports a web to a detaching location where the web is to be detached from the wire and transported to a press section. A felt travels up to and beyond the detaching location to engage the web at the detaching location and receive the web from the wire while continuing to transport the web, while it adheres to the felt, to the press section. At the detaching location, by way of a structure which preferably is in the form of a suction box, a flow of air is created to travel first through the wire, then through the web, and then through the felt with this flow of air being highly localized so as to travel only through a relatively narrow rectangular area which extends transversely across the felt throughout the entire width thereof as well as the entire width of the web and wire. At the same time, the felt is guided when travelling beyond the detaching location so as to be deflected away from the wire, with the web adhering to the felt, through a relatively small angle along a path which makes with the wire an angle of substantially less than 45°.

10 Claims, 8 Drawing Figures

PAPER MANUFACTURING STRUCTURE PARTICULARLY FOR DETACHING A WEB FROM A WIRE

BACKGROUND OF THE INVENTION

The present invention relates to paper-manufacturing machines.

In particular, the present invention relates to machines of this type which are concerned with the detaching of the paper web from the forming wire which may, for example, be a wire part of which forms part of a twin-wire former, with this wire transporting the web beyond the twin-wire former.

The invention relates in particular to a method and apparatus of the above type designed to transport the web without any open draw from the wire to the press section of the paper machine, so that the web is continuously supported as it travels from the wire to the press section. Preferably a transfer suction box is utilized for the purpose of contributing toward detaching of the web from the wire and adhering the web to a felt which transports the web from the wire to the press section.

As is well known, the operations in connection with which a web, which has been formed on the wire of a paper machine, is detached from the wire and transferred to the press section are extremely important, having a great influence on the reliability of the operation of the paper machine. In paper machines which operate at relatively low speeds, it is possible to utilize open draws resulting from a speed differential between the wire and press sections.

However, with paper machines which operate at high speeds or which are utilized in the manufacture of relatively thin and therefore low-strength paper, it is known that closed transfer systems, without any open draw, must be utilized, so that the web is continuously supported while it travels from the wire to the press section. Systems of this latter type usually operate in such a manner that a transfer felt of the press section is guided into contact with the web on the wire. Such a transfer felt is pressed by way of a rotating roll against the web on the wire so that the web adheres to the felt to become detached from the wire and to continue to be transported by the felt which then transports the web to the first press nip of the press section.

In general there are two main types of closed transfer systems. The simplest is the so-called lick-up transfer based on the capability of a wet "lick-up" felt to adhere the paper web to its surface. The other type of closed transfer system is a vacuum pick-up system which developed from the first system. By providing at the transfer point a vacuum, it is possible to reliably bring about transfer of the web from the wire to the felt with the web adhering reliably to the felt. A vacuum type of pick-up system offers greater possibilities than the first system, particularly, for example, with regard to the selection of the quality of the felt. Particularly in those cases where the transfer felt also operates as a press felt, several requirements are imposed on the transfer felt. These requirements include a requirement that the web must adhere reliably to the surface of the felt at the attaching location while on the other hand the felt must function efficiently at the dewatering first press nip of the press section.

Vacuum pick-up systems utilizing a suction roll at the detaching location have gained a wide use. However, such conventional systems are encumbered by a number of drawbacks.

Thus, a suction roll of the above type may undesirably leave on the web a marking which detracts from the appearance of the paper and may undesirably influence the surface properties thereof. In addition, suction rolls are expensive, requiring an individual driving motor and control system, and they are exceedingly noisy in operation. Furthermore, such suction rolls consume a great deal of air, due not only to the fact that the air which passes through the web and felt also enters into the suction system but also due to the fact that the air arriving in the suction zone in the holes of the suction roll shell must be moved out of these holes at least once during each revolution of the shell. In addition, numerous difficulties result from the fact that proper seals must be maintained by sealing water at the suction box which forms part of the suction roll.

The detaching of the web from the wire in a conventional Fourdrinier machine takes place at a location situated on the wire run between the couch roll and the traction roll. At this location the wire travels downwardly at an angle of approximately 45° with respect to a horizontal plane. This detaching location is determined by the usual construction of the wire section and press section and by their location with respect to each other. Subsequent to the detaching location the pick-up felt and the web adhering thereto lap the pick-up roll through an angle of about 70°–90°, and then the felt and the web adhering thereto travel to the press section. This latter change in the direction of travel of the felt at the detaching location, caused by the above lapping of the pick-up roll by the felt, causes under some circumstances, such as high speed or an unsuitable felt, a tendency for the web to detach itself from the pick-up felt as a result of the action of centrifugal force. In order to counteract this latter tendency for detachment of the web from the felt at the detaching location, it is essential to provide the pick-up roll with a suction zone extending through a substantial distance beyond the detaching zone itself. In this way it is possible to insure that the web will remain adhering to the felt, but of course this reliability in the operation is obtained at the cost of a considerable additional load on the suction system of the pick-up roll. As a result, the suction roll requires a capacity in addition to that which would be required if the task of the suction roll were only to effect detachment of the web from the wire and adhering the web to the felt.

Partly because of the above circumstances, it has already been proposed to utilize stationary transfer suction boxes at the detaching location, instead of a rotary suction roll, and while in this way some of the above drawbacks are avoided, nevertheless even with such stationary suction boxes some of the above drawbacks still remain. With respect to the state of the art associated with the present invention, reference may be made in particular to U.S. Pat. Nos. 3,441,476, 3,528,881, and 3,537,955.

SUMMARY OF THE INVENTION

It is accordingly a primary object of the present invention to provide apparatus which will avoid the above drawbacks.

In particular, it is an object of the present invention to provide apparatus capable of accomplishing an effective transfer of the web from the wire to a transfer felt while utilizing kinetic energy of the rotating and travelling structural elements of the wire section as well as of the web itself, while also making effective use of centrifugal force in various ways to contribute to detaching of the web from the wire and adhering thereof to the transfer felt while at the same time minimizing the expenditure particularly of suction energy.

According to the invention a web is carried by a wire to a detaching location where the web is to be detached from the wire and to be transported to a press section of a paper machine. A transfer felt travels to the detaching location to engage the web at the latter location, and within the loop of the transfer felt there is a transfer suction box. This transfer suction box has one or more slots through which suction is applied for creating a flow of air travelling first through the wire, then through the web and then through the felt, so that in this way the web will become detached from the wire and will adhere to the transfer felt. The detaching location is preferably situated subsequent to a guide roll or return roll of the wire which is situated within the loop of the wire, although the detaching location is close to the latter roll. Immediately subsequent to the detaching location the felt with the web adhering thereto is deflected away from the wire through a relatively small angle, this deflection being brought about by the curvature of a wall of the suction box which forms a means which guides the transfer felt with the web adhering thereto away from the wire, the extent of deflection being quite small and substantially less than 45°. With the web thus adhering to the surface of the felt, the latter travels to the first press nip of a press section, this latter nip being a double-felted nip where the transfer felt itself forms the upper felt of the double-felted press nip. At the region of the first press nip the web is acted upon by suction to assure retaining the web in engagement with the transfer felt which together with the web travels beyond the first press nip to a second press nip of the press section, this second press nip being formed by a roll which guides the transfer felt at the first and second press nips as well as a further smooth-surfaced roll of the press section.

The roll which guides the felt at the first and second press nips is preferably a water-receiving roll, the surface of which may be grooved or provided with any bores or recesses to receive water. A second press felt forms the other felt of the double-felted first press nip, the second press felt cooperating also with a water-receiving press roll, so that at the first press nip water is extracted from the web in a pair of opposite directions. A smooth-surfaced press roll forms the second press nip with the transfer felt, and a third press felt cooperates with the smooth-surfaced press roll to define a third press nip therewith, the web being detached from the transfer felt at the second press nip and travelling around the smooth-surfaced press roll to the third press nip which preferably also cooperates with a water-receiving roll situated in the loop of this third press felt.

The present invention is particularly applicable to modern twin-wire formers which offer greater possibilities, as compared with Fourdrinier wire sections, for selection of the detaching location in such a way that the advantageous web-detachment of the present invention can be applied.

Furthermore, a particularly advantageous feature of the invention resides in deflecting the transfer felt when it travels beyond the detaching location away from the wire from which the web has been detached to as small an extent as possible, so that as a result of this feature no suction is actually required to maintain the web adhering to the surface of the transfer felt as the web travels with the transfer felt beyond the detaching location. Because of the exceedingly small deflection of the transfer felt with the web adhering thereto away from the wire, the web reliably remains adhering to the felt as a result of the surface tension force between the felt and the web, and no additional suction force is required, so that the particular felt which is utilized may be selected with this factor in mind.

At the stage where the transfer felt and the web adhering thereto arrive at the first press nip, where the transfer felt in the particular application of the present invention laps the upper roll of the first press nip, which is a suction roll, centrifugal force at this upper roll of the first press nip may tend to induce the web to become detached from the downwardly directed lower surface of the felt. In order to avoid such an occurrence, with the invention the suction zone of the upper press roll at the first press nip is extended to a location in advance of the first press nip so that the web is reliably maintained adhering to the felt as the latter approaches the first press nip while curving around the press roll which is lapped by the transfer felt. At the same time, the so-called blowing phenomenon is avoided. In other words, detachment of the web from the felt owing to the phenomenon that in the throat formed by the pick-up or transfer belt and the surface of the suction roll a pressure is generated by the effect of air which the felt and the roll surface include between themselves.

The detaching location of the invention may be situated at different parts of a given machine depending upon the construction of the wire section. However, this detaching location is at all events situated after and adjacent to the roll, such as the return roll, over which the wire passes while undergoing a substantial change in its direction of travel together with the web which is transported by the wire. The centrifugal force which results from this substantial change in the direction of travel of the wire contributes to the detachment of the web from the wire, and thus by this particular location of the detaching location, in accordance with the invention, advantage is taken of the centrifugal force, so that the suction force required to transfer the web from the wire to the felt can be minimized. The extent of the above substantial change in the direction of travel of the wire depends upon the diameter of the roll around which the wire is guided as well as the machine speed. If the machine operates at high speed, then even a relatively minor change in direction may be considered as being substantial in the sense that under these conditions there will still be a tendency of the web to become detached from the wire as a result of centrifugal force. At a given machine speed, the centrifugal force created at a relatively small diameter roll is higher than that produced by a larger diameter roll, the centrifugal force being inversely proportional to the radius of curvature of such a roll.

Even though there is a tendency for the web to become detached from the wire as a result of centrifugal force when the wire undergoes a substantial change in its direction of travel just in advance of the detaching location, nevertheless it is essential with the invention to provide a means which will create a flow of air travelling first through the wire then through the web and then through the felt at the detaching location, this latter means preferably taking the form of a suction transfer box, so that in this way the web will surely be transferred to the transfer felt in a highly reliable manner, with the felt then carrying the web to the first press nip of the press section as pointed out above. The most advantageous embodiment of the invention is one where the transfer suction box is situated relatively close to that roll which provides the above change in the direction of travel of the wire, the transfer suction box even being situated directly opposite to the latter roll, although it is preferred to situate the transfer suction box at a distance, which may be relatively small, beyond the latter roll.

It is also advantageous in accordance with the invention to provide for the suction transfer box an adjusting means enabling the attitude and location of suction box to be adjusted. In this way it is possible to provide the most favorable contact and the location of the suction slot of the suction box with respect to the transfer felt so as to determine in this way the best possible detaching location. In addition, it is preferred to provide the transfer suction box with a means which will enable the pressure therein to be regulated, and in this way it is possible to optimize the suction transfer operation at the detaching location.

BRIEF DESCRIPTION OF DRAWINGS

The invention is illustrated by way of example in the accompanying drawings which form part of this application and in which.

DESCRIPTION OF PREFERRED EMBODIMENTS

Figure 1:
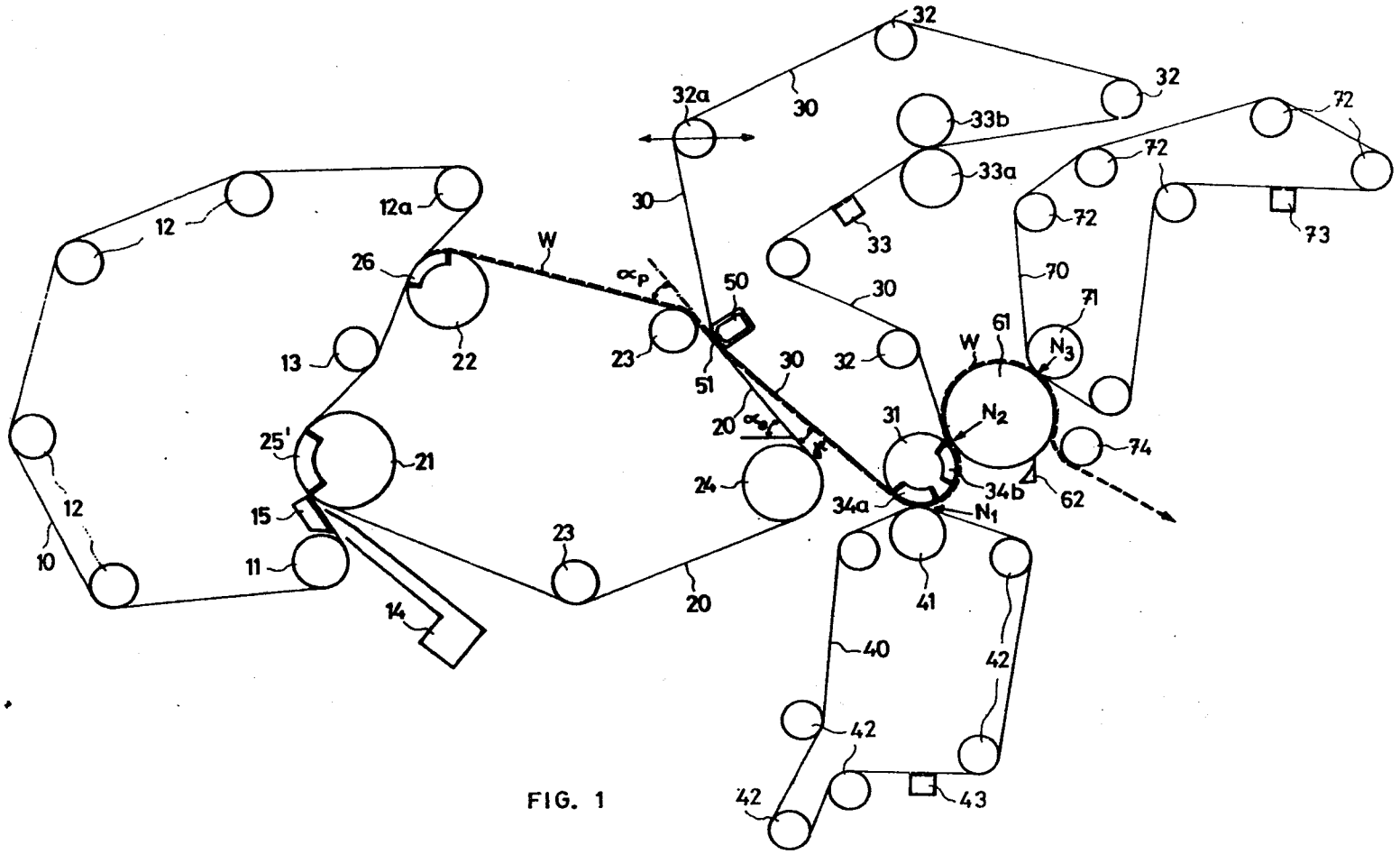
FIG. 1 is a schematic illustration of a machine according to the invention, FIG. 1 illustrating a twin-wire former having one of its wires transporting the web to the detaching location with FIG. 1 showing not only how the web is detached from the wire at the detaching location but also how the web is then transported through the press section which is illustrated also in FIG. 1.

Referring first to FIG. 1, there is schematically illustrated therein the web-forming section as well as the press section of a paper machine. The web-forming section includes a pair of endless wire loops 10 and 20 which have portions travelling upwardly along a common path to provide in this way a twin-wire former. The wire 10 is guided by way of the rolls 12 and also engages a guide roll 13 situated at an intermediate location along the path of common travel of the twin wires. In addition, this particular wire 10 laps the breast roll 11 to form a single-wire portion receiving pulp stock from the headbox 14. The twin-wire former includes a lower forming roll 21, and a forming board 15 engages the single-wire portion extending from the breast roll 11 to the lower forming roll 21. The forming board 15 has either a solid wall or a perforated wall engaging the wire 10. The lower forming roll 21, which is situated within the wire loop 20 has a suction zone 25' in the region which dewatering of the web takes place. This dewatering takes place simultaneously in opposed directions, namely outwardly away from the roll 21 as a result of centrifugal force and inwardly toward the latter through the suction zone 25'. The wires 10 and 20 travel along a common path upwardly beyond the lower forming roll 21, while being guided by the intermediate roll 13, to an upper forming roll or couch roll 22 provided with a suction zone 26 which assures that the web W which is formed, when travelling beyond the twin-wire forming path, will continue to be transported by the wire 20 downwardly toward the right beyond the upper forming roll 22, as viewed in FIG. 1. The wire 20 is guided by way of suitable guide rolls 23.

Figure 2:
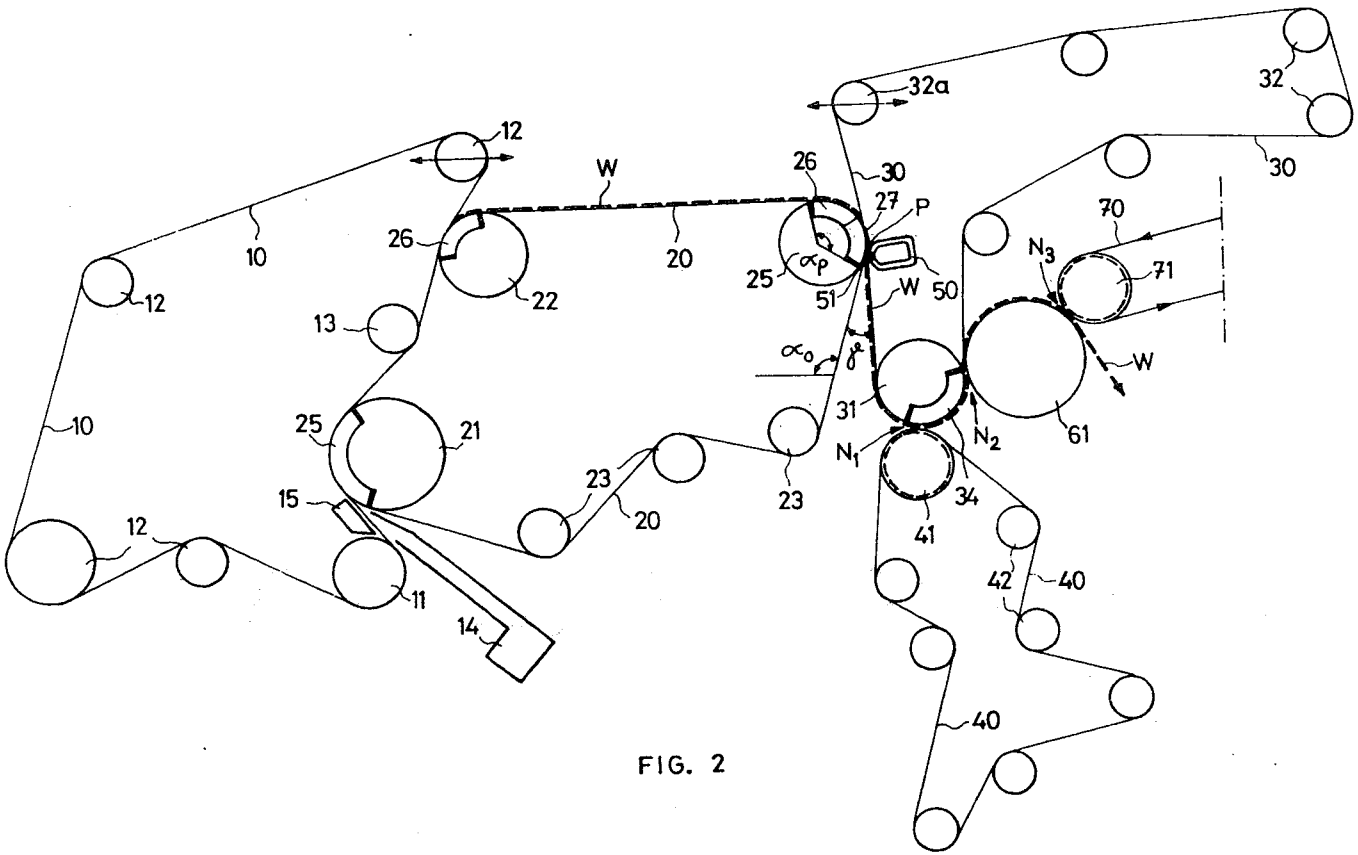
FIG. 2 is a schematic illustration of a machine similar to that of FIG. 1, the structure at the region of detaching location being different in FIG. 2 from that illustrated in FIG. 1, and in addition structure at the press section is also somewhat different in FIG. 2 as compared with FIG. 1.

As is apparent from FIG. 1, the detaching location where the web W is detached from the wire 20 and transferred to a transfer felt 30 is situated along that part of the wire 20 which travels downwardly toward the right, as viewed in FIG. 1, from the upper guide roll 23 toward the return roll 24. The return roll is that particular roll within the wire loop 20 which is at the greatest distance from the forming roll. In the case of FIG. 2, it will be seen that the wire 20 travels around a return roll 25 with the detaching location being situated at the wire 20 when the latter has just travelled beyond the return roll 25. FIG. 2 indicates the detaching location P. In the embodiment shown in FIG. 2, the return roll 25 has a foraminous shell and has in its interior a suction zone 26 followed by a blowing zone 27.

Thus it will be seen that both in FIG. 1 and in FIG. 2 the detaching location is situated at a part of the wire 20 which is travelling downwardly. The angle at which this particular part of the wire travels downwardly, with respect to a horizontal plane, is the angle $\alpha_0$. In FIG. 1 this angle $\alpha_0$ is slightly more than 45°, while in FIG. 2, the same equivalent angle is greater than 90°.

Moreover, in FIGS. 1 and 2, the web W is transferred to a transfer felt 30 which forms the first felt of the press section, this transfer being brought about by a means which creates a flow of air first through the wire 20 then through the web W and then through the transfer felt 30, with the flow of air being highly localized so as to extend entirely across the felt 30 but in a narrow substantially rectangular area, as will be apparent from the description below. This means which creates the flow of air preferably is the illustrated suction box 50 which exerts on the web W carried by the wire 20 a suction effect while at the same time the wall of the suction box 50 which engages the felt 30 is suitably curved so as to form a means for guiding the felt 30 so that it will be deflected through a small angle away from the wire 20 as the felt 30 travels beyond the detaching location with the web W adhering to the felt 30. Thus, the convex curvature of the wall of the suction box 50 which engages the felt 30 is such that the felt 30 is deflected away from the wire 20 through the illustrated angle $\gamma$ which is an extremely small angle, substantially less than 45°, and preferably less than 10°.

The transfer felt 30 is guided by way of guide rolls 32, and a conditioning apparatus 33 is provided for the felt 33 as well as a washing press which has the rolls **33*a*** and 33*b*. As is indicated schematically in FIGS. 1 and 2, the particular guide roll 32*a* is adjustable so that the transfer felt 30 can be guided to the detaching location P in such a way that the felt 30 will cover the wire 20 and the web W thereon over an area or sector of a suitable magnitude in advance of the detaching location P. In this way the attaching of the web W to the transfer felt 30 can be enhanced.

As is apparent from FIGS. 1 and 2, the transfer felt 30 simultaneously serves as the upper felt at the first press nip $N_1$ of the press section of the paper machine. This first press nip is defined between press rolls 31 and 41, and the lower roll 41 is a water-accepting roll having a surface which is suitably recessed for this purpose. This lower roll 41 has its own felt loop 40 which is guided by way of guide rolls 42 and which is provided with a conditioning means 43. The upper roll 31 of the first press nip $N_1$ is a suction roll and is provided with a suction zone 34 indicated in FIG. 2, the roll 31 having in FIG. 1 the suction zones 34*a* and 34*b*. Thus, in FIG. 1 the suction zone of the roll 31 has a plurality of compartments. The initial suction zone 34*a* in FIG. 1 extends in advance of the press nip $N_1$ to such an extent that any possible detachment of the web W from the felt 30 as a result, for example, of centrifugal force will be prevented. By providing the roll 31 with a plurality of suction sectors such as the sector 34*a*, 34*b* shown in FIG. 1, it is possible to minimize the required suction capacity.

The press section further includes a smooth-surfaced central roll 61 which together with the upper roll 31 of the first press nip forms the second press nip $N_2$, this roll 61 cooperating with a press roll 71 so as to define a third press nip $N_3$. The roll 71 has a recessed surface capable of receiving water, as shown schematically in FIG. 2. This roll 71 has its own felt loop 70, as shown in FIG. 1, guided by guide rolls 72, and a felt conditioner 73 cooperates with the felt loop 70. The smooth-surfaced central press roll 61 is cleaned by a doctor blade 62 which is indicated in FIG. 1. From the roll 61 the web is detached in a well known manner and while guided by a roll 74 travels to the drying section of the machine.

It will be noted that in FIG. 1 the wire 10 is guided by a guide roll 12*a* subsequent to the common path of travel of the wires 10 and 20, while in FIG. 2 this corresponding roll 12 is shown as being horizontally adjustable.

Figure 3:
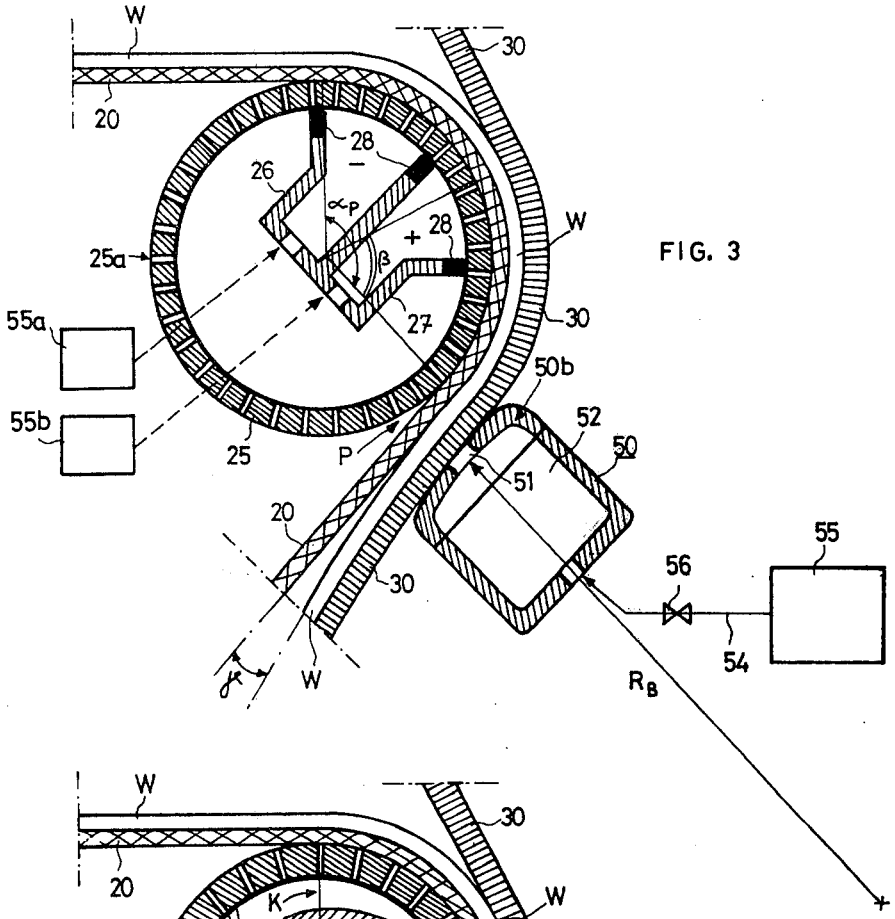
FIGS. 3 and 4 are respectively fragmentary sectional schematic illustrations of the features of the invention at the detaching location, FIGS. 3 and 4 in particular showing details which may be associated with the embodiment of FIG. 2 with FIGS. 3 and 4 respectively showing different embodiments of a return roll for the wire as well as different details associated with the suction box at the detaching location.

Referring to FIG. 3, which shows in greater detail the construction of the roll 25 of FIG. 2, it will be seen that the wire 20 travels together with the web W in a clockwise direction around the illustrated return roll 25. In this way the wire 20 and web W travel toward the detaching location P. Thus, as indicated in FIG. 3, the wire 20 laps the roll 25 through the illustrated angle $\alpha_P$ while undergoing a substantial change in direction. It is the centrifugal force occurring at this part of the construction which contributes to detaching of the web W from the wire 20. The roll 25 is illustrated as having a perforated shell 25*a*, and in the interior of the shell there is the suction chamber 26 followed by the blowing chamber 27. The transfer felt 30 is guided toward the detaching location P in such a way that the transfer felt 30 also laps around the roll 25 through the illustrated angle $\beta$, and it will be noted that part of this region is occupied by the blowing zone 27.

For the purpose of detaching the web W from the wire 20 there is also within the loop of the felt 30 a transfer suction box 50, which has already been referred to above, this transfer suction box having in engagement with the felt a wall 50*b* formed with an elongated slot 51 which extends transversely across the felt 30 throughout the entire width thereof. The transfer suction box 50 has a hollow interior 52 forming a suction chamber and communicating through a pipe 54, which has a regulating valve 56, with a suction means 55.

Figure 4:
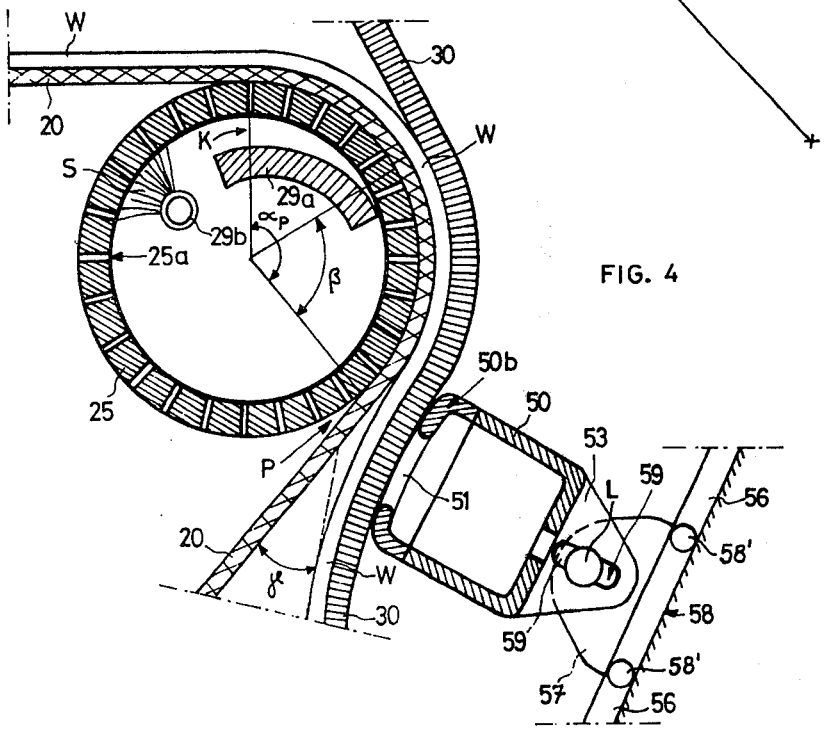

Referring to FIG. 4, the particular return roll 25 illustrated therein also has a perforated shell 25*a*. However, in this case the interior of the roll 25 does not have any suction or blowing chambers. Instead there is situated within the interior of the roll 25 a stationary baffle 29*a* which is curved so as to provide a blowing action in response to rotation of the roll 25 in a clockwise direction, as viewed in FIG. 4, with respect to the stationary baffle 29*a*. In addition, there is situated within the interior of the roll 25 of FIG. 4 a pipe 29*b* having a plurality of outlet nozzles directed upwardly toward the left, as viewed in FIG. 4, for a purpose referred to below. According to the embodiment of FIG. 4, the transfer felt 30 is lapped around the roll 25 through the sector $\beta$ which is on the order of 60°, this lapping of the felt 30 starting immediately after the blowing sector provided by way of the curved baffle 29*a*. It is of course possible for the felt 30 partly to overlap the blowing sector if such an arrangement is considered to be advantageous.

FIG. 4 illustrates a transfer suction box 50 which may be the same as the suction box 50 of FIG. 3 although in the illustrated example of FIG. 4 the slot 51 is somewhat wider. FIG. 4 illustrates an adjusting means operatively connected with the transfer suction box 54 for adjusting the attitude and location thereof. Thus this adjusting means includes a plate 53 fixed to and projecting from the suction box 50 and formed with a slot 59 receiving a bolt L which can be tightened and loosened and which passes through a threaded opening in a plate 57 which is fixed to a rail 56 which can slide up and down in an inclined guide groove of a stationary supporting structure 58 shown schematically in FIG. 4. Bolts 58' serve not only to fix the plate 57 to the slide rail 59 but also to press against a portion of the guide 58 so that after the position of the plate 57 is adjusted the bolts 58' can be tightened to maintain the rail 56 in its adjusted position. In addition, when the screw L is loosened, the entire box 50 can be moved toward and away from the detaching location, as a result of the slot 59, while also being capable of turning angularly about the axis of the screw L, so that in this way the location of the box 50 can be adjusted, and once the desired location is provided the screw L is tightened. Thus this adjusting means will provide for adjustment not only of the location of the suction box but also of the attitude thereof. In this way the suction box 50 can be positioned to achieve an optimum transfer operation.

Figure 8:
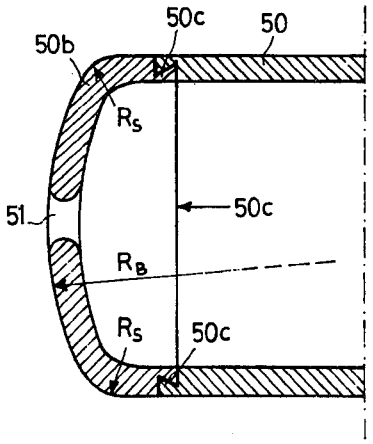

In FIG. 3, the wall 50*b* forms a removable cover for the suction box 50, and this wall serves as a means to guide the felt 30 for travel along a path deflected away from the wire 20 through the angle $\gamma$, as pointed out above. For this purpose the exterior surface of the wall 50*b* which engages the felt 30 is convexly curved and has the illustrated radius $R_B$ (FIG. 8). This radius is chosen almost arbitrarily to have a large magnitude which under all circumstances is much larger than the radius of other known types of suction arrangements situated at the corresponding location. Because of this large radius, it follows that the deflection angle $\gamma$ between the felt 30 and the wire 20 is extremely small. As a result of this feature at the detaching location P there will be no appreciable centrifugal force acting on the web W, tending to oppose adhering thereof to the felt 30, so that this feature contributes to insuring that the web W will travel together with the felt 30 while adhering thereto, while at the same time the extent of the force of suction provided at the box 50 can be minimized since this suction force need not be great enough to oppose any centrifugal force which might tend to prevent reliable adhering of the web W to the felt 30.

Figure 5:
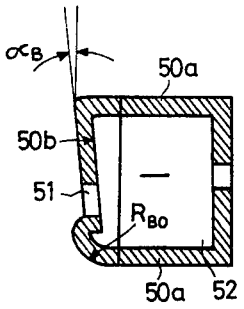
FIGS. 5–8 are respectively sectional schematic illustrations of various different possible embodiments of suction boxes of the invention capable of being utilized at the detaching location.
Figure 7:
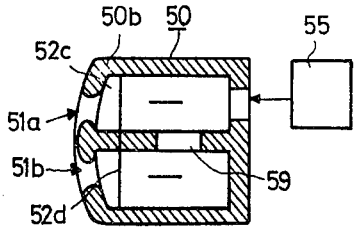
Figure 6:
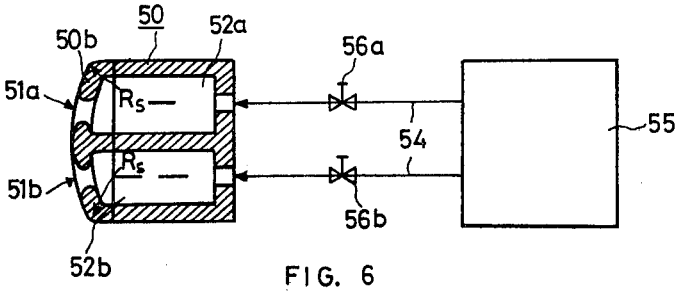

FIGS. 5–7 respectively illustrate various structural alternatives for the transfer suction box 50. As is indicated in FIG. 5, the cover or wall **50*b* of the transfer suction box 50*a* has a foil-like construction, this wall having the foil angle $\alpha_B$. At the lower part of the wall 50*b*, as viewed in FIG. 5, this wall has the indicated radius $R_{BO}$, this part of the foil structure being situated subsequent to the slot 51 through which the suction is applied. As a result of the foil construction of the cover 50*b*** the force of suction is enhanced. The transfer suction box can include more than one foil-like portion.

As is indicated in FIG. 6, the interior of the transfer suction box 50 can have a partition means dividing this interior into a pair of suction chambers **52*a* and 52*b*, both of which communicate with their own slots 51*a* and 51*b*, respectively. The separate chambers 52*a* and 52*b* communicate separately through pipes 54 with the suction means 55, and these pipes 54 have their own regulating valves 56*a* and 56*b*, respectively. By adjusting these valves it is possible to provide different degrees of vacuum in the chambers 52*a* and 52*b* so that the suction effect can be adjusted with respect to its distribution, as desired. For example, the adjustment may be such that at the upper slot 51*a* there is a suction of lesser intensity than at the lower slot 51*b*, so that in this way as the web and felt travel first past the slot 51*a* and then past the slot 51*b***, there will initially be a lesser suction force with the latter increasing in intensity.

As is indicated in FIG. 7, it is also possible to provide the interior of the suction box with separate chambers by way of a suitable partition means, but in this case both chambers communicate with each other through an opening 59 formed in the partition means. Thus the suction means 55 communicates only with the upper suction chamber of FIG. 7 which shows the separate chambers **52*c* and 52*d* communicating with each other through the opening 59. Thus in this case equal extents of vacuum prevail in both of the chambers, but these vacuums are applied through the separate slots 51*a* and 51*b***.

With a view to minimizing wear of the transfer felt 30 both at the leading and trailing edges of the suction box, at these edges the suction box has been curved with the radius $R_S$, as indicated in FIGS. 6 and 8.

As has been indicated above, the cover or wall **50*b* of the suction box is preferably removable, and FIG. 8 illustrates a construction provided for this purpose. Thus the cover 50*b* is attached to the remainder of the suction box by way of a suitable tongue-and-groove structure which in FIG. 8 takes the form of a dovetail joint 50*c*. As is understood from the above description and the drawings, the suction box is of an elongated narrow configuration extending transversely across the entire width of the machine, and the cover 50*b* will have the dovetail structure 50*c* along its upper and lower edges while the ends of the cover will also have a fluid-tight engagement with the opposed side walls of the box 50. Thus it is a simple matter whenever required to remove one cover 50*b* so that it may be cleaned and replaced or so that it may be replaced by a cover 50*b*** of a different construction according to the particular requirements of the operation which is desired.

Referring now to FIGS. 1 and 2, the headbox 14 of course supplies pulp stock to the wire 10 to be delivered to the twin-wire former with water escaping to some extent at the forming board 15 in advance of the forming roll 21 although dewatering primarily takes place at the forming roll 21. The dewatering continues at a lesser rate at the guide roll 13 with some dewatering also taking place at the couch roll 22. The suction sector 26 of the roll 22 causes the web W to remain attached to the wire 20 so as to be carried thereby to the detaching location P. At the latter location the transfer felt 30, which also forms part of the press section, contacts the web W, the transfer belt 30 being urged by the suction box 50 against the web W so that the latter adheres to the felt 30. This adherence is partly based upon adhesion between the web W and the felt 30, but the suction is provided at the suction box 50 in order to insure a reliable transfer.

With the web W thus attached to the felt 30, the web W travels with the felt 30 to the first press nip $N_1$. Thus the first press nip is defined between the upper roll 31 and the lower roll 41 which is a water-accepting roll having a suitably grooved surface, for example. This roll 41 of course has its own felt 40. Subsequent to the first press nip the web W remains attached to the felt 30 as a result of the suction prevailing at the zone 34 of the suction roll 31, and thus the web is transferred with the felt 30 to the second press nip $N_2$.

At the second press nip $N_2$, defined between the roll 31 and the smooth-surface roll 61, the felt 30 also is compressed together with the web W, but at this point the web W becomes detached from the felt 30 and travels together with the roll 61 to the third press nip $N_3$. This third press nip $N_3$ is provided by situating in cooperation with the roll 61 a water-accepting roll 71 which has its own felt loop 70, as pointed out above. This roll 71 is also a roll such as a grooved roll capable of accepting water, and at the third press nip $N_3$ the web is further dewatered so that the dry matter content thereof increases. The web however still adheres to the smooth-surface roll 61 and subsequent to the third press nip $N_3$ there may still be one more press nip although such an additional press nip has not been illustrated. Instead the web W has been shown as being detached from the roll 61 in a conventional manner, as a result of the differential speed, and it is then transported to the drying section of the paper machine which in itself is well known.

Referring now to FIGS. 3 and 4, as is illustrated in FIG. 3 the wet web W arrives, supported by the wire 20, at the return roll 25 where the web W is subjected to the suction provided at the suction sector 26 which has the sealing strips 28. The extension of this latter sector depends upon the desired power and duration of the suction effect at this location. The purpose of this suction sector is to assist in the dewatering of the web W in the event that the dry matter content thereof is insufficient subsequent to the couch roll 22. A suction pump **55*a* is shown schematically cooperating with the suction zone 26**. The use of suction is not always absolutely necessary at this location.

Substantially at the point where the suction zone 26 terminates, the felt 30 is conducted into engagement with the web W still engaging the wire 20, so as to make the web W adhere to the felt 30. The adherence of the web W to the felt 30 may be promoted in various ways.

One advantageous manner is to provide for internal blowing at the compartment 27 over the roll 25, this compartment 27 being supplied with compressed air from a suitable compressed air source 55*b* which is schematically indicated. The size of this pressure zone 27 is advantageously equal to the size of the sector of the roll 25 where the web is sandwiched between the wire 20 and the felt 30. However, in this case also blowing carried out by way of the pressure zone 27 is not always essential. The position of the suction and pressure zones 26 and 27 may be rendered adjustable so that the most favorable positions can be provided with a view to bringing about the most effective web detachment. FIG. 3 indicates that only the sector $\beta$ is jointly covered by the wire 20, the web W and the felt 30 to receive the pressure effect. After the web W has been in contact with the felt 30 for a sufficient length of time at the region of the shell of the roll 25, the web W together with the wire 20 and the felt 30 reached the detaching location P where the suction acts through the slot 51 of the box 50 so as to finally bring about the attachment of the web W to the felt 30 so that the web will continue to travel with the felt 30 to the first press nip, as pointed out above.

The suction aperture of the transfer suction box is in the form of the slot 51 which extends over the entire breadth of the web W. The width of the slot 51 can be varied. This is brought about by replacing one cover 50*b* which has a slot of a given width with another cover which has a slot of a different width. Also, there may of course be more than one slot as pointed out above. By localizing the flow of air resulting from the suction at the slot 51 to a relatively narrow area extending transversely across the web and felt and having a substantially rectangular cross section, it is possible to bring about a clear, continuous and straight detachment of the web from the wire along a clearly defined transverse line, so as to insure proper operation of the suction transfer.

The interchangeability of the covers of the suction box so as to adjust the nature of the slot or slots through which the suction is applied enables the suction effect to be optimized in accordance with the particular conditions which are encountered. Through this procedure it is possible to insure an efficient transfer with the lowest possible air consumption. Similar possibilities do not exist when utilizing a suction roll.

The cover or wall 50*b* of the suction box is made of a suitable material such as, for example, of a special plastic or of a ceramic material which has a low friction with respect to the felt 30. The cover component of the suction box is very carefully manufactured, and the edges of the slot 51 are suitably ground and rounded. By utilizing the slot 51 of the suction chamber there is the advantage, as compared with a foraminous wall of a suction box, that the edges which can produce wear on the felt are greatly minimized. In addition it is much easier to manufacture the straight slot with its rounded, ground edges, than to provide an equivalent treatment for a large number of apertures.

If, for example, the length of the slot 51 is 8 m and the breadth thereof is 25 mm (approximately 1 inch), then the area of the slot will be on the order of 2,000 $cm^2$. The combined total length of the edges of such a slot is equal to 16050 mm.

If it is desired to provide an equally large suction area formed by apertures each of which has an area of 1 $cm^2$, then a total of 2,000 apertures are required. The diameter of each aperture is 1.13 cm and the circumference of each of each aperture is 35.4 mm. Thus, the total edge length of such a number of apertures is 70800 mm. It will be seen, therefore, that an equivalent area provided by apertures of a foraminous wall requires more than four times the edge length as compared with the suction slot of the suction box of the invention.

Even if two slots are utilized having each, for example, a width of 10 mm and 15 mm, then of course the combined edge length will increase to 32050 mm. However, even in this case the total edge length is still less than half of the above total edge length of the apertures.

With respect to the embodiment shown in FIG. 4, the rotation of the foraminous shell of the illustrated return roll 25 produces a slight blowing effect acting on the web but sufficient in certain cases to detach the web W from the wire 20. This blowing effect is enhanced in the illustrated example in that the inner surface of the shell of the roll 25 and the eccentrically curved baffle 29*a* cooperate to define a narrowing throat K tapering in the direction of rotation of the roll so as to enhance the blowing effect. The position of baffle 29*a* within the roll can be selected so that an efficient pressure is provided. The detachment of the web W from the wire 20 and its transfer to the felt 30 takes place in the case of FIG. 4, while the web W travels in succession through a blowing zone, a press zone, an initial transfer zone, and the final suction zone provided by way of the slot 51.

Referring further to FIG. 4 it will be seen that one possibility for detaching the web W which is in part entangled in the mesh of the wire 20, is to use in this connection an aid in the form of water. Thus, the pipe 29*b* receives water under pressure which flowing out through the nozzles issues as a jet spray S engaging the inner surface of the rotary shell of the roll 25. As a result of centrifugal force, this water will pass through the apertures of the foraminous roll shell 25*a*, and this passage of this water through these apertures is also aided by way of the suction at the suction box 50. As a result, this water will be received in the mesh of the wire 20 in order to facilitate in this way detaching of the web W from the wire 20. Otherwise the suction transfer of FIG. 4 proceeds in a manner described above in connection with FIG. 3. It is also within the scope of the invention to provide an embodiment where the suction transfer box is utilized in connection with a smooth wire guiding roll 23, as illustrated in FIG. 1. Such a possibility can be considered in the case where adherence of the web W to the wire 20 is not very great and particularly if the roll 23 just in advance of the detaching location provides a centrifugal force, due to the change in direction of the wire at this roll 23, which is great enough to bring about the desired detachment of the web W from the wire 20.

This particular wire guide roll 23 in connection with which detachment of the web W from the wire 20 takes place may also be a grooved roll. When such roll is utilized it is possible to enhance or optimize the conditions in connection with the transfer process at the region of such a guide roll, these conditions being compression of the transfer felt, movement of water expressed from the felt and also from the web, and other phenomena. Moreover, a grooved roll will produce a more powerful self-blowing effect than a smooth roll. While a grooved roll is preferred, it is also possible to utilize a roll having drilled in its shell a large number of openings which pass only partly through the shell.

It is most advantageous if the transfer suction box 50 is situated adjacent to a comparatively large diameter roll, most appropriately the return roll which takes up the loads due to the tension of the wire 20. As a result of the large diameter of such a roll, the web W will travel around such a roll over a relatively long interval, so that there remains sufficient time for preliminary detachment of the web W from the wire 20 and for its preliminary transfer to the felt 30 with the web W having sufficient time to become attached to the required extent to the felt 30 before the final detachment from wire 20.

The transfer suction box 50 of the invention is situated in accordance with the invention adjacent to a roll such as the upper roll 23 of FIG. 1 or the roll 25 of FIGS. 2–4, with the distance between the transfer suction box and such a roll being no greater than, at most, substantially the length of the diameter of such a roll.

In connection with the type of roll with which the transfer box 50 is utilized, this factor depends upon the operating conditions of the wire section, the machine speed, the base weight of the paper that is being manufactured, these conditions in turn determining the dry matter content of the web when it arrives at the detaching location P. The fabric structure of the wire 20 is also of significance. The web will adhere very strongly to wire fabrics of certain types and very little to other types of wire fabrics, and in this latter event of course the web W can easily be detached from the wire 20.

Of course, the invention is in no way confined to the above embodiments, described in detail above and shown in the drawing, inasmuch as the details of the inventive concept may vary within the scope of the claims which follow below.

What is claimed is:

1. In a paper machine, wire means for transporting a web to a detaching location where the web is to be detached from the wire means and transported to a press section, felt means extending up to and beyond said detaching location for receiving the web detached from said wire means at said detaching location and transporting the web to the press section, the web being sandwiched between the wire means and felt means at said detaching location, air-flow means situated adjacent said detaching location for creating a flow of air travelling in a direction through the wire means toward the web and through the web toward the felt means as well as through and beyond the latter, with said air-flow means localizing said flow of air to a relatively narrow rectangular area extending transversely across the wire means, web, and felt means, and guide means situated at said detaching location and engaging said felt means for guiding the latter beyond said detaching location with the web adhering thereto while deflecting the felt means away from the wire means through a relatively small angle which is substantially less than 45°, said means creating said flow of air including a suction box situated in engagement with said felt means at the side thereof opposite from said web and having in engagement with said felt means a wall formed with an elongated slot which defines said localized area for said flow of air and through which air is sucked to flow first through said wire means, then through said web and then through said felt means into said suction box, said wall of said suction box having an exterior convexly curved surface engaging said felt means and forming said guide means, said wall of said suction box being formed with a pair of said slots situated one after the other in the direction of travel of said felt means, and said suction box having in its interior a partition means defining in the interior of said suction box separate chambers which respectively communicate with said slots.

2. The combination of claim 1 and wherein an adjusting means is operatively connected with said suction box for adjusting the location and attitude thereof.

3. The combination of claim 1 and wherein said wire means forms a closed loop, and return roll means situated within said closed loop in engagement with said wire means for changing the direction thereof to return said wire means back to a web-forming zone, said return roll means being located adjacent but in advance of said detaching location.

4. The combination of claim 3 and wherein said wire means has at said web-forming zone a portion forming part of a twin-wire former.

5. The combination of claim 1 wherein a press section for receiving the web detached from said wire means at said detaching location includes a double-felted first press nip formed between upper and lower felts of which the upper felt is formed by said felt means.

6. The combination of claim 1 and wherein said wall of said suction box forms for the suction box a cover which is removably connected to the suction box so that one cover of one construction can be exchanged for another cover for another construction.

7. The combination of claim 6 and wherein said cover has a tongue-and-groove type of connection with a remainder of said suction box.

8. The combination of claim 7 and wherein said tongue-and-groove type of connection is a dovetail type of connection.

9. The combination of claim 1 and wherein said partition means is formed with an opening passing therethrough so that chambers communicate with each other, and suction means communicating with only one of said chambers.

10. The combination of claim 1 and wherein a suction means respectively communicates with said chambers for providing therein different degrees of suction, respectively.

* * * * *